United States Patent [19]

Kamino

[11] 4,236,919

[45] Dec. 2, 1980

[54] MAGNETIC ALLOY

[75] Inventor: Kimiyuki Kamino, Tokyo, Japan

[73] Assignee: Mitsubishi Seiko Kabushiki Kaisha, Tokyo, Japan

[21] Appl. No.: 972,472

[22] Filed: Dec. 22, 1978

[30] Foreign Application Priority Data

Jun. 6, 1978 [JP] Japan ..... 53/73197

[51] Int. Cl.[3] ..... C22C 38/18

[52] U.S. Cl. ..... 75/126 H; 75/124; 148/31.57

[58] Field of Search ..... 75/126 HC, 126 D, 126 E, 75/126 F, 124; 148/31.57

[56] References Cited

U.S. PATENT DOCUMENTS

| | | | |
|---|---|---|---|
| 3,806,336 | 4/1974 | Kameko | 148/31.57 |
| 3,954,519 | 5/1976 | Inoue | 75/126 H |
| 4,008,105 | 2/1977 | Yuda et al. | 75/126 H |
| 4,075,437 | 2/1978 | Chin et al. | 148/108 |
| 4,093,477 | 6/1978 | Iwata et al. | 148/108 |
| 4,120,704 | 10/1978 | Anderson | 75/126 H |

FOREIGN PATENT DOCUMENTS

| | | | |
|---|---|---|---|
| 51-5612 | 2/1976 | Japan | 148/31.57 |

*Primary Examiner*—R. Dean
*Assistant Examiner*—John P. Sheehan
*Attorney, Agent, or Firm*—Robert E. Burns; Emmanuel J. Lobato; Bruce L. Adams

[57] ABSTRACT

A magnetic alloy of the Fe-Cr-Co type having superior magnetic properties compared to those of the conventional magnetic alloys of this kind and consisting essentially of, by weight, 5 to 30%Co, 15 to 35%Cr, 0.1 to 10%Ti, 0.1 to 10%V, 0.005 to 0.03%C, 0 to 0.1%Al, and the balance being Fe. The magnetic alloy according to the present invention may further contain 0.1 to 5% of one of the elements selected from the group consisting of W, Mo, Zr and Ta.

2 Claims, No Drawings

MAGNETIC ALLOY

BACKGROUND OF THE INVENTION

The present invention relates to a magnetic alloy and more particularly to a magnetic alloy of the Fe-Cr-Co type such as is known in the art as a spinodal decomposition type magnetic alloy.

The Fe-Cr-Co type magnetic alloy has been known as having a quite superior quality in machinability compared to conventional magnetic alloys, and its fundamental constitution is described in U.S. Pat. No. 3,806,336. In the Fe-Cr-Co magnetic alloy it has been known also that at the time of spinodal decomposition of the ferromagnetic $\alpha$-phase into two phases, i.e. $\alpha_1$-phase (ferromagnetic phase) and $\alpha_2$-phase (nonmagnetic phase), it is desirable that the decomposition temperature Tsp and the Curie point Tc of the $\alpha$-phase coincide from the point of view of magnetic properties. Further it has been also known that the $\alpha_1$-phase, i.e. ferromagnetic phase, produced by the spinodal decomposition is possible to be controlled in its growth direction by a magnetic field applied externally. On the other hand it has been also known that there exist $\gamma$- and $\sigma$-phases, which are nonmagnetic as well as stable, intermediate the $\alpha$-phase which is stable at a higher temperature and the lower temperature range at which the spinodal decomposition begins to occur.

As a result, in order to use a Fe-Cr-Co type magnetic alloy as excellent material for a permanent magnet, it is understandable that it should be constituted so as not to contain a $\gamma$- and/or $\sigma$-phase as abovesaid and at the same time it should have a Tsp equal or nearly equal to Tc. Hitherto many studies have already been done for the purpose of realizing the above principle and also many publications dealing with the realization have been issued.

SUMMARY OF THE INVENTION

It is an object of the present invention to provide a magnetic alloy of the Fe-Cr-Co type which has its magnetic properties improved further than those realized in the conventional magnetic alloys of this kind.

It is another object of the present invention to provide a magnetic alloy of the Fe-Cr-Co type in which the content ranges of C and Al are specifically strictly limited in order to enable it to exhibit superior magnetic properties.

In accordance with the present invention, a magnetic alloy of the Fe-Cr-Co type is provided which is characterized by consisting essentially of, by weight, 5 to 30 %Co, 15 to 35%Cr, 0.1 to 10%Ti, 0.1 to 10%V, 0.005 to 0.03%C, 0 to 0.1%Al, and the balance being Fe. The magnetic alloy according to the present invention may further contain 0.1 to 5% of one of the elements selected from the group consisting of W, Mo, Zr and Ta.

DESCRIPTION OF PREFERRED EMBODIMENTS

As stated above, the magnetic alloy according to the present invention is characterized in consisting essentially of, by weight, 5 to 30%Co, 15 to 35%Cr, 0.1 to 10%Ti, 0.1 to 10%V, 0.005 to 0.03%C, 0 to 0.1%Al, the balance being Fe, and it may further contain 0.1 to 5% of one of the elements selected from the group consisting of W, Mo, Zr and Ta.

The magnetic alloy according to the present invention has been developed to obtain an alloy which has a constitution in which no $\gamma$- or $\sigma$-phase exists as before explained and which can realize the condition where the Tsp nearly equals the Tc. However, in the present invention, although the effects of the respective added elements have not yet been theoretically analyzed, and at present they can only be explained experimentally, if the magnetic alloy according to the present invention is explained from this point of view, the addition of V is effective in expelling the $\gamma$-phase to the Cr-poor side and the $\sigma$-phase to the Cr-rich side, whereby the $\gamma$- and $\sigma$-phases exists in such a manner that they coexist with the $\alpha$-phase in the course of its decomposition into the $\alpha_1$ and $\alpha_2$-phases. For instance, in the case of an alloy comprising Fe-15%Co-23%Cr-3%V-2%Ti, the $\alpha$-phase can exist at the lower temperature at which the spinodal decomposition begins to occur independently of the $\gamma$- and/or $\sigma$-phase. See "The Report of the 1976 INTERMAG Conference" 7E-8, by Kaneko, Honma and Miwa of Tohoku University. On the other hand, it has been substantially acknowledged that in an alloy of Fe-Cr-Co, when Co and/or V are added the Tc becomes high, while many other elements, lower it when added. However, it is the status quo that the effects of various elements on an alloy of Fe-Cr-Co when they are added in combination are so complicated that they are hardly predicable.

As stated above, the composition of the magnetic alloy according to the present invention has been determined on the basis of vast experiments which were carried out for the purpose of improving the magnetic properties, and particularly as to the amounts of Al and C among the other composition elements defines either the necessary amounts when they are to be added intentionally, or the upper limits when they necessarily originally exist in the alloy elements.

Therefore, among the elements constituting the present magnetic alloy, the amounts of C and Al in particular have to be strictly specified. However, this is not the case with other alloys.

Thus, in carrying out the present invention precise consideration should be given to the amount of C or Al in the raw materials. That is, should C exist in an amount exceeding the specified amount of 0.03 wt% it will bring about a decrease in the magnetization saturation as well as in the coercive force. As to Al, when it exists in an amount exceeding 0.1 wt%, it has the same tendency as C. In particular, in the case of Al it is considered that Al not only contributes to a lower Tc, but also its role as an $\alpha$-phase forming agent stabilizes the $\alpha$-phase so that the spinodal decomposition does not easily occur.

The mechanism of the coercive force in a spinodal magnetic alloy of the Fe-Cr-Co type is indebted largely to the shape anistropy of the ferromagnetic phase which exists dispersively in the nonmagnetic phase.

Consequently it is clear that the growth of the $\alpha_1$-phase under the action of a magnetic field is adversely affected if the Tsp is deviated largely from the Tc.

Following is the description of the preferred embodiments of the present invention, which it is believed will assist in the full understanding of the magnetic alloys of the present invention.

EXAMPLE 1

Samples including the magnetic alloy according to the present invention were prepared by combining various raw materials as shown in Table 1. The relationship between the combinations of the raw materials and the compositions of the samples is shown in Table 2.

As shown in Table 2, the experiments were carried out to investigate the influence of C contained in the iron raw materials on the magnetic properties. The respective samples were obtained by melting the raw materials in a high-frequency induction furnace, having a capacity of 1 kg, in the air and poring the melt into shell molds each being 13 mm in diameter×15 mm in length. The samples were then subjected to a magnetic field treatment at a temperature of 660° C. for 1 hour and subsequently to a multistage aging treatment from 620° C. to 540° C.

TABLE 1

| No. | Raw Materials Item | Chemical Composition (wt %) C | S | P | Si | Mn | Cu | Al | Fe |
|---|---|---|---|---|---|---|---|---|---|
| 1 | Electrolytic Iron | 0.005 | 0.005 | 0.004 | 0.005 | 0.005 | 0.004 | — | balance |
| 2 | Deoxidized Pure Iron "A" | 0.046 | 0.013 | 0.015 | 0.19 | 0.32 | 0.02 | 0.019 | balance |
| 3 | Deoxidized Pure Iron "B" | 0.016 | 0.007 | 0.011 | Tr | 0.03 | 0.010 | — | balance |
| 4 | Granular Cobalt | 0.010 | 0.007 | — | 0.025 | 0.013 | 0.015 | 0.030 | 0.14 |
| 5 | Low Carbon Fe—Cr No. 2 | 0.029 | 0.010 | 0.023 | 0.50 | — | — | — | 38.938 |
| 6 | Fe—V No. 2 | 0.040 | 0.010 | 0.028 | 0.68 | — | — | 3.0 | 44.242 |
| 7 | Electrolytic Aluminum | — | — | — | — | — | — | 99.99 | — |
| 8 | Low Carbon Fe—Ti No. 1 | 0.080 | 0.010 | 0.010 | 0.02 | 0.20 | 0.03 | 0.05 | 57.900 |
| 9 | Fe—W | 0.036 | 0.010 | 0.012 | 0.05 | 0.02 | 0.07 | — | 20.822 |

TABLE 2

| Sample No. | Composition | Raw Materials |
|---|---|---|
| I | Fe-15% Co-21% Cr-3% V-2% Ti | 1, 4, 5, 6, 8 |
| II | " | 2, 4, 5, 6, 8 |
| III | " | 3, 4, 5, 6, 8 |

The magnetic properties and the amounts of C analyzed in the respective specimens are shown in Table 3.

TABLE 3

| Sample No. | Br(KG) | Hc(Oe) | (B . H)m(MGOe) | C(wt. %) |
|---|---|---|---|---|
| I | 14.4 | 580 | 6.1 | 0.011 |
| II | 13.6 | 530 | 4.0 | 0.036 |
| III | 14.0 | 590 | 5.9 | 0.019 |

As suggested by Sample No. II in Table 3, if the amount of C becomes more than 0.03 wt%, deviating from the range of C as specified in the present invention, in particular the decrease in coercive force Hc is severe.

EXAMPLE 2

Three Samples, Nos. IV, V and VI, including the magnetic alloy according to the present invention were prepared by adding 0.1, 0.2 and 0.5 wt% of Al, respectively, into a magnetic alloy comprising Fe-15%-Co-21%Cr-3%V-2%Ti. The Raw Materials, Nos. 3, 4, 7 and 8 shown in Table 1, were used and as V pure vanadium (purity: 99.7%) was used. The manufacturing procedure and the heat treatment were similar to those in the case of Example 1. The magnetic properties and the values of chemical analysis are shown in Table 4.

TABLE 4

| Sample No. | Br(KG) | Hc(Oe) | (B . H)m(MGOe) | Al (wt %) | C (wt %) |
|---|---|---|---|---|---|
| IV | 14.2 | 580 | 6.0 | 0.09 | 0.018 |
| V | 14.0 | 500 | 5.0 | 0.17 | 0.016 |
| VI | 13.0 | 400 | 3.5 | 0.48 | 0.013 |

From Table 4 it can be deduced that in Sample Nos. V and VI, if the amount of Al exceeds 0.1 wt%, as specified in the present invention, in particular the decrease in coercive force Hc is large.

By the way, although, in the case of Example 1, as V ferro-vanadium was used, it was innevitable to include Al in an amount of a few wt% due to the fact that the ferro-vanadium was manufactured by the thermit method. Consequently, since the ratio of the content of V to the whole weight of the alloy was 3 wt% the residual amount of Al within the melted samples was below 0.01 wt%, so as to raise no problem. This can also be confirmed from the results of the measurement of the magnetic properties of Example 2 as shown in Table 4.

EXAMPLE 3

Sample Nos. VII and VIII including the magnetic alloy according to the present invention were prepared, respectively combining Raw Material Nos. 3, 4, 5, 6, 8, 9 and Nos. 2, 4, 5, 6, 8, 9 shown in Table 1 so as to each have a constitution of Fe-15%Co-21%Cr-2%Ti-1%V-2%W. Sample No. IX was also prepared from Raw Material Nos. 3, 4, 5, 6, 8, 9 with further electrolyte aluminum being added in an amount of 0.2 wt% in relation to the total weight. These samples were all manufactured by the same procedure as in the case of Example 1.

The magnetic values and the analyzed chemical compositions of the respective samples are shown in Table 5.

TABLE 5

| Sample No. | Br(KG) | Hc(Oe) | (B . H)m(MGOe) | Al (wt %) | C (wt %) |
|---|---|---|---|---|---|
| VII | 14.8 | 630 | 6.8 | 0.01 | 0.015 |
| VIII | 13.2 | 520 | 3.7 | 0.01 | 0.040 |
| IX | 14.0 | 510 | 4.0 | 0.15 | 0.013 |

As will be seen from Table 5, Sample No. VII which was prepared in accordance with the present invention shows that the effect due to the addition of W is clearly revealed in the coercive force Hc. Contrarily, it will be appreciated that in Sample No. VIII, owing to the content of C in an amount of 0.040 wt%, exceeding the range limit of 0.03 wt% in the present invention, and in Sample No. IX, owing to the content of Al in an amount of 0.15 wt%, exceeding the range limit of 0.10 wt% in the present invention, the effects respectively obtainable by the addition of C and Al are counterbalanced.

From the forgoing it will be understood that in the present invention, unless the contents of C and Al are limited to fall within the ranges 0.005 to 0.03 wt% and 0 to 0.1 wt%, respectively, as specified in the present invention, the decrease in magnetic properties is severe; in particular, it results in detrioration in the rectangularity of the 2nd quadrant of the hysteresis curve, which is fatal to the properties as a magnetic alloy.

What is claimed is:

1. A magnetic alloy of the Fe-Cr-Co type consisting essentially of, by weight, 5 to 30%Co, 15 to 35%Cr, 0.1 to 10%Ti, 0.1 to 10%V, 0.005 to 0.03%C, 0 to 0.1%Al, and the balance being Fe.

2. A magnetic alloy of the Fe-Cr-Co type consisting essentially of, by weight, 5 to 30% Co, 15 to 35% Cr, 0.1 to 10% Ti, 0.1 to 10% V, 0.005 to 0.03 C, 0 to 0.1% Al, 0.1 to 5% X and the balance Fe wherein X is an element selected from the group consisting of W, Mo, Zr and Ta.

* * * * *